US008512485B2

(12) United States Patent
Feng et al.

(10) Patent No.: US 8,512,485 B2
(45) Date of Patent: Aug. 20, 2013

(54) ALLOY

(75) Inventors: Ganjiang Feng, Greenville, SC (US); George A. Goller, Greenville, SC (US); Raymond Joseph Stonitsch, Simpsonville, SC (US); Jason R. Parolini, Greenville, SC (US); Shan Liu, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/983,413

(22) Filed: Jan. 3, 2011

(65) Prior Publication Data

US 2012/0171070 A1 Jul. 5, 2012

(51) Int. Cl.
*C22C 30/00* (2006.01)

(52) U.S. Cl.
USPC ..... 148/419; 148/427; 148/442; 420/584.1; 420/586.1

(58) Field of Classification Search
USPC ..... 148/419, 427, 442; 420/584.1, 586.1
See application file for complete search history.

(56) References Cited

U.S. PATENT DOCUMENTS 3,663,213 A * 5/1972 Eiselstein et al. ..... 420/586.1
5,415,712 A 5/1995 Thamboo

FOREIGN PATENT DOCUMENTS

EP 0774526 A1 5/1997
EP 1486578 A1 12/2004
FR 2078328 A5 11/1971
GB 760926 A * 11/1956

OTHER PUBLICATIONS

Hong, H.U., Kim, I.S., Choi, B.G., Kim, M.Y. and Jo, C.Y. The effect of grain boundary serration on creep resistance in a wrought nickel-based superalloy, Materials Science and Engineering A 517 (2009) 125-131.*

Wang, H.M.; Yu, L.G.; and Jiang, P., Growth morphology and mechanism of MC carbide under quasi-rapid solidification conditions, Science and Technology of Advanced Materials 2 (2001) 173-176.*

Ping, D.H.; Gu, Y.F.; Cui, C.Y.; and Harada, H., Grain boundary segregation in Ni—Fe-based (Alloy 718) superalloy, Materials Science and Engineering A 456 (2007) 99-102.*

EP Search Report from Application No. 11194749.5 dated Apr. 25, 2012.

* cited by examiner

*Primary Examiner* — Sikyin Ip

(74) *Attorney, Agent, or Firm* — McNees Wallace & Nurick LLC

(57) ABSTRACT

A alloy and a process of forming a alloy are disclosed. The alloy has a predetermined grain boundary morphology. The alloy includes by weight greater than about 0.06 percent carbon, up to about 0.0015 percent sulfur, less than about 16 percent chromium, between about 39 percent and about 44 percent nickel, between about 2.5 percent and about 3.3 percent niobium, between about 1.4 percent and about 2 percent titanium, up to about 0.5 percent aluminum, up to about 0.006 percent boron, up to about 0.3 percent copper, up to about 0.006 percent nitrogen, and greater than about 0.5 percent molybdenum.

6 Claims, No Drawings

ALLOY

FIELD OF THE INVENTION

The present invention is directed to alloys and articles including alloy. More specifically, the present invention is directed to an alloy and articles including an alloy having a predetermined grain boundary morphology.

BACKGROUND OF THE INVENTION

The operating temperature within a gas turbine is both thermally and chemically hostile. Significant advances in high temperature capabilities have been achieved through the development of iron, nickel, and cobalt-based superalloys and the use of environmental coatings capable of protecting superalloys from oxidation, hot corrosion, etc., but coating systems continue to be developed to improve the performance of the materials.

In the compressor portion of a gas turbine, atmospheric air is compressed to 10-25 times atmospheric pressure, and adiabatically heated to 800° F.-1250° F. (427° C.-677° C.) in the process. This heated and compressed air is directed into a combustor, where it is mixed with fuel. The fuel is ignited, and the combustion process heats the gases to very high temperatures, in excess of 3000° F. (1650° C.). These hot gases pass through the turbine, where airfoils fixed to rotating turbine disks extract energy to drive the fan and compressor of the turbine, and the exhaust system, where the gases provide sufficient thrust to propel the aircraft. To improve the efficiency of operation of the turbine, combustion temperatures have been raised. Of course, as the combustion temperature is raised, steps must be taken to prevent thermal degradation of the materials forming the flow path for these hot gases of combustion.

Using certain known alloys results in coarse grain size and grain boundary cracking under such conditions. For example, it is well know that coarse grain size and grain boundary cracking may be concerns for Inconel Alloy 706 components such as rotors and turbine disks (Inconel is a registered trademark of Inco Alloys International, Inc., Huntington, W. Va.). As identified in AMS specification 5703B, Inconel Alloy 706 has the composition by weight of carbon 0.06 max, manganese 0.35 max, phosphorus 0.35 max, sulfur 0.015 max, chromium 14.5 to 17.5, nickel 39 to 44, niobium 2.5 to 3.3, titanium 1.5 to 2, aluminum 0.4 max, boron 0.006 max, copper 0.3 max, and a balance of iron.

Known processes attempt to remedy this susceptibility to cracking by focusing on the forging process and the heat treatment processes. For example, two-step and three-step aging processes have been used to generate Eta phase along grain boundaries, which reduces the crack growth rate along the grain boundaries. However, the aging heat treatment is applied after uncontrolled grain growth already took place during forging and/or during solution heat treatment. As a result, the forgings typically have a very coarse grain size, which can increase intergranular cracking susceptibility.

Inconel Alloy 706 may also form grain boundary carbide films. Carbides having high chromium content can be easily dissolved at forging temperature. As a result, chromium redistributes along the grain boundaries as carbide films during the cooling. This may lead to embrittlement and significantly increased intergranular cracking susceptibility.

Known alloys add rhenium and change the aluminum-niobium ratio to reduce the coarsening rate of gamma double prime phase. However, these approaches have no impact on the grain coarsening and intergranular cracking. In other known alloys, chromium content is increased (for example, to about 18%) and titanium content is increased (for example, to about 1.9%). This creates a stronger alloy with reduced ductility.

A alloy and process of forming a alloy controlling grain size and grain boundary that does not suffer from the above drawbacks would be desirable in the art.

BRIEF DESCRIPTION OF THE INVENTION

According to an exemplary embodiment of the present disclosure, an alloy includes by weight greater than about 0.06 percent carbon, up to about 0.0015 percent sulfur, less than about 16 percent chromium, between about 39 percent and about 44 percent nickel, between about 2.5 percent and 3.3 percent niobium, between about 1.4 percent and about 2 percent titanium, up to about 0.5 percent aluminum, up to about 0.006 percent boron, up to about 0.3 percent copper, up to about 0.006 percent nitrogen, greater than about 0.5 percent molybdenum, and a balance of iron.

According to another exemplary embodiment of the present disclosure, an alloy includes by weight up to about 0.06 percent carbon, up to about 0.0015 percent sulfur, less than about 16 percent chromium, between about 39 percent and about 44 percent nickel, between about 2.5 percent and about 3.3 percent niobium, between about 1.4 percent and about 2 percent titanium, up to about 0.5 percent aluminum, up to about 0.006 percent boron, up to about 0.3 percent copper, up to about 0.006 percent nitrogen, greater than about 0.5 percent molybdenum, greater than about 0.5 percent tungsten, and a balance of iron.

According to another exemplary embodiment of the present disclosure, an alloy includes MC carbides dispersed with one or more of molybdenum and tungsten, wherein the MC carbides form a zig-zag morphology in the grain boundaries of the alloy.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is an alloy and a process of forming a alloy with controlled grain size and grain boundary. Embodiments of the present disclosure resist intergranular cracking, resist embrittlement, form a desired grain boundary morphology such as zig-zag morphology, retard grain coarsening, extend the useful life of components formed from the alloy, extend inspection intervals for monitoring components formed from the alloy, permit operation of a gas turbine at high temperatures thereby improving efficiency, and combinations thereof The alloy can be a portion of any suitable component. For example, the alloy can be a rotor or turbine disk, for example, for a gas turbine.

In an exemplary embodiment, a alloy having a composition range includes a predetermined grain boundary. In one embodiment, the predetermined grain boundary morphology includes a zig-zag morphology. By forming the alloy with the zig-zag morphology, the alloy is resistant to intergranular cracking, maintains strength up to about 1200° F., is resistant to embrittlement, has a high recrystallization temperature and, therefore, a low tendency for grain growth, and combinations thereof.

In one embodiment, the composition range by weight is greater than about 0.06 percent carbon, up to about 0.0015 percent sulfur, less than about 16 percent chromium, between about 39 percent and about 44 percent nickel, between about 2.5 percent and about 3.3 percent niobium, between about 1.4 percent and about 2 percent titanium, up to about 0.5 percent aluminum, up to about 0.006 percent boron, up to about 0.3 percent copper, up to about 0.006 percent nitrogen, greater than about 0.5 percent molybdenum, and a balance of iron. In a further embodiment, the alloy includes by weight between about 0.06 percent and about 0.7 percent carbon, up to about 0.0015 percent sulfur, between about 14 percent and about 16 percent chromium, between about 39 percent and about 44 percent nickel, between about 2.5 percent and about 3.3 percent niobium, between about 1.4 percent and about 1.7 percent titanium, between about 0.2 percent and about 0.5 percent aluminum, up to about 0.006 percent boron, up to about 0.3 percent copper, up to 0.006 percent nitrogen, between about 0.8 percent and about 2.7 percent molybdenum, and a balance of iron.

In one embodiment, the alloy includes a composition. In one embodiment, the composition is by weight about 0.06 percent carbon, up to about 0.0015 percent sulfur, about 15 percent chromium, about 40 percent nickel, about 2.9 percent niobium, about 1.5 percent titanium, about 0.45 percent aluminum, about 0.006 percent boron, about 0.3 percent copper, about 0.006 percent nitrogen, about 2.5 percent molybdenum, and a balance of iron. In another embodiment, the composition is by weight 0.06 percent carbon, up to 0.0015 percent sulfur, 15 percent chromium, 40 percent nickel, 2.9 percent niobium, 1.5 percent titanium, 0.45 percent aluminum, 0.006 percent boron, 0.3 percent copper, 0.006 percent nitrogen, 2.5 percent molybdenum, and a balance of iron.

In one embodiment, the alloy includes a composition range of by weight up to about 0.06 percent carbon, up to about 0.0015 percent sulfur, less than about 16 percent chromium, between about 39 percent and about 44 percent nickel, between about 2.5 percent and about 3.3 percent niobium, between about 1.4 percent and about 2 percent titanium, up to about 0.5 percent aluminum, up to about 0.006 percent boron, up to about 0.3 percent copper, up to about 0.006 percent nitrogen, greater than about 0.5 molybdenum, greater than about 0.5 tungsten, and a balance of iron. In a further embodiment, the alloy includes by weight less than about 0.000005 percent nitrogen. In this embodiment, the presence of (TiC)N particles, which are hard regular-shaped particles and act as crack initiation sites, are reduced or eliminated.

In one embodiment, the alloy includes by weight between about 0.06 percent and about 0.7 percent carbon, up to about 0.0015 percent sulfur, between about 14 percent and about 16 percent chromium, between about 39 percent and about 44 percent nickel, between about 2.5 percent and about 3.3 percent niobium, between about 1.4 percent and about 1.7 percent titanium, between about 0.2 percent and about 0.5 percent aluminum, up to about 0.006 percent boron, up to about 0.3 percent copper, up to about 0.006 percent nitrogen, between about 0.8 percent and about 2.7 percent molybdenum, between about 0.8 percent and about 2.2 percent tungsten, and a balance of iron.

In one embodiment, the alloy include by weight about 0.06 percent carbon, up to about 0.0015 percent sulfur, about 15 percent chromium, about 39.5 percent nickel, about 2.9 percent niobium, about 1.5 percent titanium, about 0.45 percent aluminum, about 0.006 percent boron, about 0.3 percent copper, about 0.006 percent nitrogen, about 1 percent molybdenum, about 2 percent tungsten, and a balance of iron.

In one embodiment, the alloy includes by weight 0.06 percent carbon, up to 0.0015 percent sulfur, 15 percent chromium, 39.5 percent nickel, 2.9 percent niobium, 1.5 percent titanium, 0.45 percent aluminum, 0.006 percent boron, 0.3 percent copper, 0.006 percent nitrogen, 1 percent molybdenum, 2 percent tungsten, and a balance of iron.

In an exemplary process of forming the alloy, MC carbides with one or more of molybdenum and tungsten are dispersed. The MC carbides mechanically block grain coarsening and generate a zig-zag morphology in the grain boundaries. In one embodiment, the MC carbides comprise molybdenum and tungsten.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An alloy, the alloy comprising by weight greater than about 0.06 percent carbon, up to about 0.0015 percent sulfur, less than about 16 percent chromium, between about 39 percent and about 44 percent nickel, between about 2.5 percent and about 3.3 percent niobium, between about 1.4 percent and about 2 percent titanium, up to about 0.5 percent aluminum, up to about 0.006 percent boron, up to about 0.3 percent copper, up to about 0.006 percent nitrogen, greater than about 0.5 percent molybdenum, greater than about 0.5 tungsten and a balance of iron, wherein a predetermined grain boundary morphology of the alloy includes MC carbides that mechanically block grain coarsening and generate a zig-zag morphology in the grain boundaries, the MC carbides comprising molybdenum and tungsten.

2. The alloy of claim 1, comprising by weight between about 0.06 percent and about 0.7 percent carbon, up to about 0.0015 percent sulfur, between about 14 percent and about 16 percent chromium, between about 39 percent and about 44 percent nickel, between about 2.5 percent and about 3.3 percent niobium, between about 1.4 percent and about 1.7 percent titanium, between about 0.2 percent and about 0.5 percent aluminum, up to about 0.006 percent boron, up to about 0.3 percent copper, up to about 0.006 percent nitrogen, between about 0.8 percent and about 2.7 percent molybdenum, and between about 0.8 percent and about 2.2 percent tungsten.

3. The alloy of claim 1, comprising by weight about 0.06 percent carbon, up to about 0.0015 percent sulfur, about 15 percent chromium, about 40 percent nickel, about 2.9 percent niobium, about 1.5 percent titanium, about 0.45 percent aluminum, about 0.006 percent boron, about 0.3 percent copper, about 0.006 percent nitrogen, and about 2.5 percent molybdenum.

4. The alloy of claim 1, comprising by weight 0.06 percent carbon, up to 0.0015 percent sulfur, 15 percent chromium, 40 percent nickel, 2.9 percent niobium, 1.5 percent titanium, 0.45 percent aluminum, 0.006 percent boron, 0.3 percent copper, 0.006 percent nitrogen, and 2.5 percent molybdenum.

5. The alloy of claim 1, wherein the alloy maintains strength up to about 1200° F.

6. The alloy of claim 1, wherein the alloy is devoid of (TiC)N particles.

* * * * *